US009108753B2

(12) United States Patent
Moore et al.

(10) Patent No.: US 9,108,753 B2
(45) Date of Patent: Aug. 18, 2015

(54) BLADDER CLAMP AND RELATED METHODS AND APPARATUS FOR WRAPPING LOADS

(75) Inventors: Philip R. Moore, Mt. Washington, KY (US); Patrick R. Lancaster, III, Louisville, KY (US); Richard L. Johnson, Lagrange, KY (US)

(73) Assignee: Lantech.com, LLC, Louisville, KY (US)

( * ) Notice: Subject to any disclaimer, the term of this patent is extended or adjusted under 35 U.S.C. 154(b) by 783 days.

(21) Appl. No.: 13/283,836

(22) Filed: Oct. 28, 2011

(65) Prior Publication Data

US 2012/0102881 A1 May 3, 2012

Related U.S. Application Data

(60) Provisional application No. 61/408,541, filed on Oct. 29, 2010.

(51) Int. Cl.

| | |
|---|---|
| ***B65B 11/02*** | (2006.01) |
| ***B65B 11/00*** | (2006.01) |
| ***B65B 11/04*** | (2006.01) |

(52) U.S. Cl.

CPC ..... *B65B 11/008* (2013.01); *B65B 11/025* (2013.01); *B65B 11/045* (2013.01)

(58) Field of Classification Search

CPC ..... B65B 11/025; B65B 2210/16; B65B 2210/18; B65B 2210/20

USPC ..... 53/210, 203, 582, 588, 399, 556, 139, 53/164; 269/139, 164

See application file for complete search history.

(56) References Cited

U.S. PATENT DOCUMENTS

| | | | | |
|---|---|---|---|---|
| 4,761,934 | A * | 8/1988 | Lancaster | 53/399 |
| 4,807,427 | A * | 2/1989 | Casteel et al. | 53/556 |
| 5,408,808 | A * | 4/1995 | Masuda et al. | 53/556 |
| 6,095,744 | A * | 8/2000 | Harrison | 414/408 |
| 6,854,247 | B2 * | 2/2005 | Lancaster et al. | 53/556 |
| 7,707,801 | B2 * | 5/2010 | Lancaster, III | 53/399 |
| 7,779,607 | B2 * | 8/2010 | Lancaster et al. | 53/399 |
| 8,037,660 | B2 * | 10/2011 | Lancaster et al. | 53/399 |
| 8,695,312 | B2 * | 4/2014 | Johnson et al. | 53/399 |
| 2006/0248858 | A1 * | 11/2006 | Lancaster | 53/399 |
| 2007/0204565 | A1 * | 9/2007 | Lancaster et al. | 53/399 |
| 2009/0293435 | A1 * | 12/2009 | Johnson et al. | 53/461 |

FOREIGN PATENT DOCUMENTS

EP 0 583 167 A1 2/1994

OTHER PUBLICATIONS

European Patent Office; Search Report and Written Opinion in International Patent Application No. PCT/US2011/058240, dated Feb. 3, 2012; 10 pages.

* cited by examiner

*Primary Examiner* — Andrew M Tecco
(74) *Attorney, Agent, or Firm* — Middleton Reutlinger

(57) ABSTRACT

A clamp assembly may include a first jaw member which may have a selectively inflatable bladder. In addition, the clamp assembly may further include a second jaw member which may have a belt. The first jaw member and the second jaw member may be configured to clamp material between the selectively inflatable bladder and the belt.

19 Claims, 13 Drawing Sheets

142
120
110
118
124
106
112
132
4B
144
140
164
4C
108
154
4C
152
160
158
126

144
124
140
132
130
124
116
128
126

BLADDER CLAMP AND RELATED METHODS AND APPARATUS FOR WRAPPING LOADS

CROSS-REFERENCE TO RELATED APPLICATIONS

This application claims the filing benefit of U.S. Provisional Patent Application Ser. No. 61/408,541 filed on Oct. 29, 2010, which is incorporated by reference herein in its entirety.

TECHNICAL FIELD

This disclosure relates generally to methods and apparatus for wrapping a load with packaging material, and more particularly, to methods and apparatus for clamping packaging material.

BACKGROUND

Loads have been wrapped with packaging material by dispensing the packaging material with a packaging material dispenser, and providing relative rotation between the load and the packaging material dispenser to cover the load with the packaging material. Semi-automatic wrapping machines exist that require attachment of a leading end portion of the packaging material to the load by an operator prior to wrapping of the load. This is typically accomplished by collapsing the leading end portion into a rope, and then inserting the rope between layers of the load or tying the rope to an edge of a pallet or any suitable outcropping on the load. This attachment must be strong enough to resist a pulling force exerted by the packaging material dispenser on the packaging material during initiation of the relative rotation between the load and the packaging material dispenser. This type of attachment makes removing the packaging material difficult after the load has been shipped to its destination and is being unwrapped. Further, throughput is decreased due to the operator having to attach the leading end portion of the packaging material to each load before wrapping the load. Additionally, collapsing the leading end portion of the packaging material reduces its effective height, thus requiring the use of more packaging material to adequately cover the load.

Automatic wrapping machines typically use packaging material clamps that grip the packaging material between two opposed surfaces and use electrical or pneumatic actuators to open and close the clamps. Such packaging material clamps may be overwrapped by the packaging material during wrapping, and may create a "tenting" effect due to their distance from the load, resulting in wasted packaging material and loosely wrapped loads. Additionally, such clamps are expensive and may require costly maintenance for the electrical and mechanical actuators. Furthermore, such clamps tend to collapse the packaging material or require collapsing of the packaging material prior to clamping, thus reducing the effective height of the packaging material.

Other machines use a vacuum device that uses suction to hold the packaging material. This typically requires that the packaging material be placed in a flat manner against the vacuum device so that the vacuum device can provide its full gripping force on the packaging material. Flat placement of the packaging material is difficult to achieve. Also, the vacuum device may damage the packaging material if the suction generated is too high, while the packaging material may be pulled off the vacuum device if the suction is too low. Furthermore, the vacuum device may have difficulty gripping a roped portion of the packaging material, where the strength of the packaging material is concentrated.

The present disclosure is directed to overcoming one or more of the above-noted problems.

SUMMARY

According to an aspect of the present disclosure, a clamp assembly may include a first jaw member which may have a selectively inflatable bladder. In addition, the clamp assembly may further include a second jaw member which may have a belt. The first jaw member and the second jaw member may be configured to clamp material between the selectively inflatable bladder and the belt.

According to another aspect of the present disclosure, a method of clamping packaging material with a clamp assembly which may have a first jaw member including a selectively inflatable bladder and a second jaw member which may have a belt may include moving the first jaw member into engagement with the packaging material. The method may further include inflating the inflatable bladder against a first surface of the packaging material and moving the second jaw member relative to the first jaw member while engaging a second surface of the packaging material opposite the first surface with the belt. Additionally, the method may include moving the belt relative to the second jaw member such that after a portion of the belt contacts a portion of the packaging material, the portion of the belt may remain fixed relative to the portion of the packaging material as the second jaw member moves relative to the first jaw member. The method may further include clamping the packaging material between the inflatable bladder and the belt without reducing a height of the packaging material.

According to yet another aspect of the present disclosure, a packaging material clamp assembly may include a first longitudinally extending jaw member which may have a selectively expandable bladder, and a second longitudinally extending jaw member which may have a belt opposed to the selectively expandable bladder. In addition, the first and second longitudinally extending jaw members may be configured to clamp packaging material between the selectively expandable bladder and the belt.

According to yet another aspect of the present disclosure, an apparatus for wrapping a load with packaging material may include a packaging material dispenser which may be configured to dispense packaging material to the load. In addition, the apparatus may include a relative rotation assembly which may be configured to provide relative rotation between the packaging material dispenser and the load. Also, the apparatus may include a clamp assembly which may have a first longitudinally extending jaw member including a selectively expandable bladder and a second longitudinally extending jaw member including a belt opposed to the selectively expandable bladder. The first and second longitudinally extending jaw members may be configured to clamp the packaging material between the selectively expandable bladder and the belt.

According to yet another aspect of the present disclosure, a method for wrapping a load with packaging material may include positioning the load in a position to be wrapped, providing relative rotation between a packaging material dispenser and the load while the packaging material dispenser dispenses the packaging material, and extending a first longitudinally extending jaw member into a path of the dispensed packaging material, wherein the first longitudinally extending jaw member may include a selectively expandable bladder thereon. In addition, the method may include over-wrapping the first longitudinally extending jaw member with packaging material such that the packaging material is adjacent the selectively expandable bladder, and extending a second longitudinally extending jaw member alongside the first longitudinally extending jaw member, wherein the second longitudinally extending jaw member may include a belt rotatably mounted thereon. Further, the method may include contacting the packaging material with the belt while moving the belt to maintain at least a portion of the belt fixed relative to the selectively expandable bladder to clamp the packaging material between the belt and the selectively expandable bladder as the second longitudinally extending jaw member is extended.

According to yet another aspect of the present disclosure, a clamp assembly may include a first jaw member including a selectively inflatable bladder with a first material engaging surface. The clamp assembly may also include a second jaw member including a second material engaging surface. The second jaw member may be movable relative to the first jaw member along a longitudinal axis of the second jaw member. The first jaw member and the second jaw member may be configured to clamp material between the first material engaging surface and the second material engaging surface.

Additional aspects and advantages of the disclosure will be set forth in the description which follows, and in part will be apparent from the description, or may be learned by practice of the disclosure. The aspects and other advantages of the disclosure will be realized and attained by the methods and apparatuses particularly pointed out in the written description and claims as well as the appended drawings.

It is to be understood that both the foregoing general description and the following detailed description are exemplary and explanatory and are intended to provide further explanation of the disclosure as claimed.

The accompanying drawings provide a further understanding of the disclosure and are incorporated in and constitute a part of the specification, illustrate embodiments of the disclosure and together with the description serve to explain the principles of the disclosure.

DETAILED DESCRIPTION

Reference will now be made to the present embodiments of the disclosure, examples of which are illustrated in the accompanying drawings. Wherever possible, the same reference numbers will be used throughout the drawings to refer to the same or like parts. The disclosures of each of: U.S. Pat. No. 4,761,934, entitled "PARALLEL BELTED CLAMP," issued Aug. 9, 1988; U.S. Pat. No. 7,779,607, entitled "WRAPPING APPARATUS INCLUDING METERED PRE-STRETCH FILM DELIVERY ASSEMBLY AND METHOD OF USING," issued Aug. 24, 2010; U.S. Patent Application Publication No. 2009/0293435 entitled "FILM CLAMP AND RELATED METHODS AND APPARATUSES FOR WRAPPING LOADS," published Dec. 3, 2009; U.S. Pat. No. 7,568,327, entitled "METHOD AND APPARATUS FOR SECURING A LOAD TO A PALLET WITH A ROPED FILM WEB," filed Jan. 30, 2004; U.S. Pat. No. 7,707,801, entitled "METHOD FOR DISPENSING A PRE-DETERMINED AMOUNT OF FILM RELATIVE TO LOAD GIRTH," filed Apr. 6, 2006; U.S. Patent Application Publication No. 2009/0178374, entitled "ELECTRONIC CONTROL OF METERED FILM DISPENSING IN A WRAPPING APPARATUS," filed Jan. 7, 2009; and U.S. Patent Application Publication No. 2007/0209324, entitled "METHOD AND APPARATUS FOR SECURING A LOAD TO A PALLET WITH A ROPED FILM WEB," filed Feb. 23, 2007, are incorporated herein by reference in their entirety.

Figure 1:
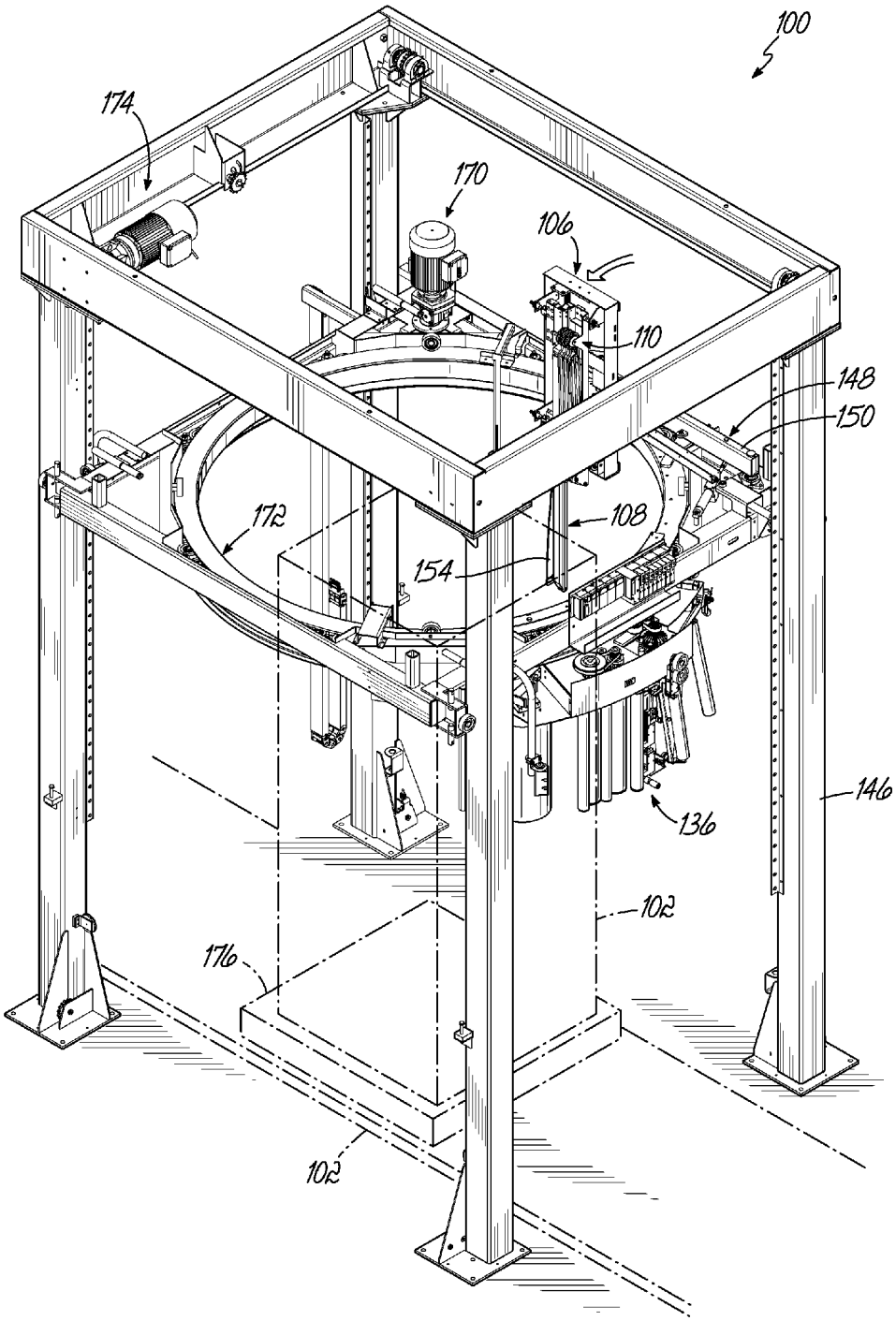
FIG. 1 is a perspective view of a stretch wrapping apparatus including an exemplary clamp assembly in accordance with an aspect of the present disclosure.
Figure 2:
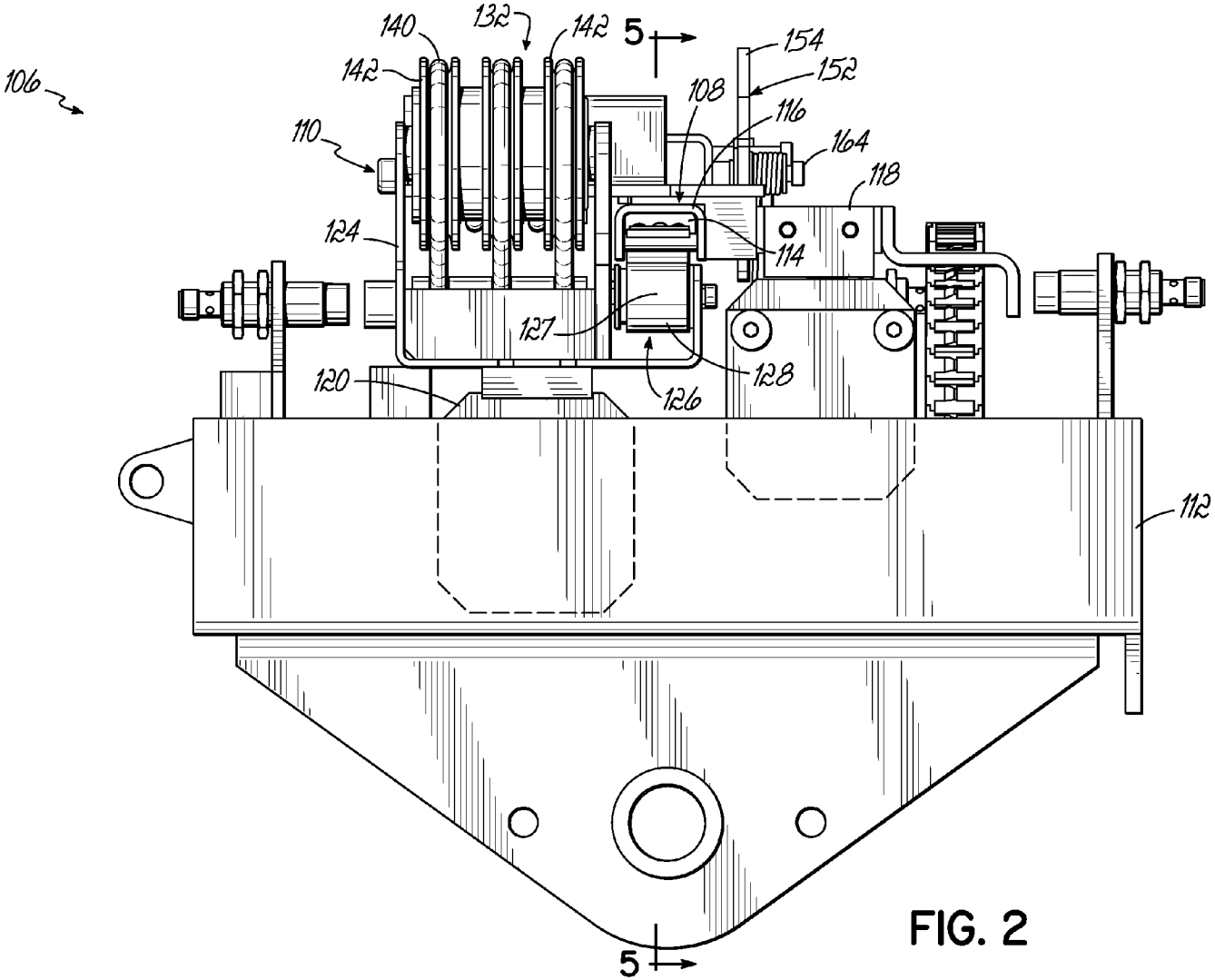
FIG. 2 is a top view of the clamp assembly of FIG. 1.
Figure 3:
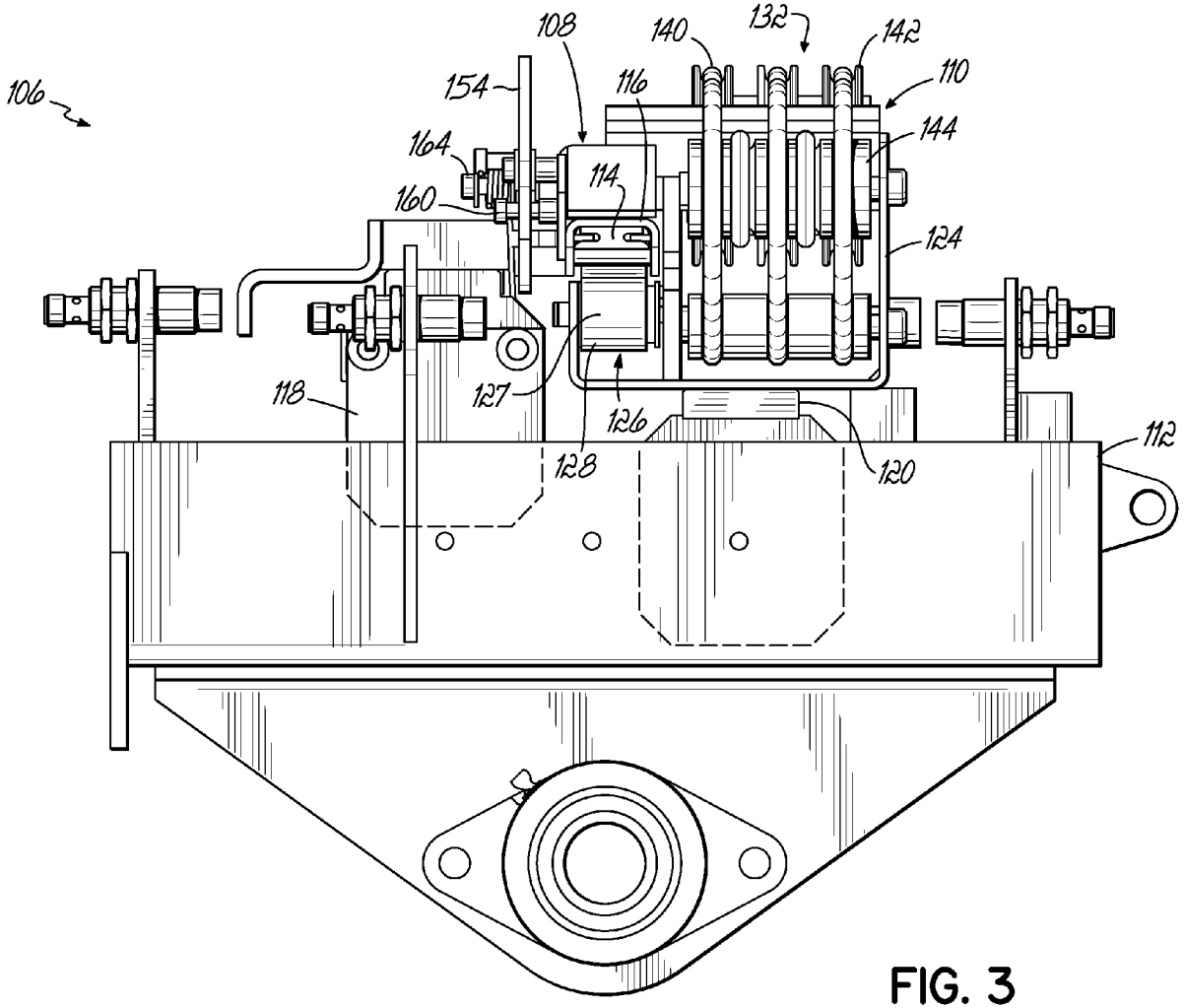
FIG. 3 is a bottom view of the clamp assembly of FIG. 1.
Figure 4:
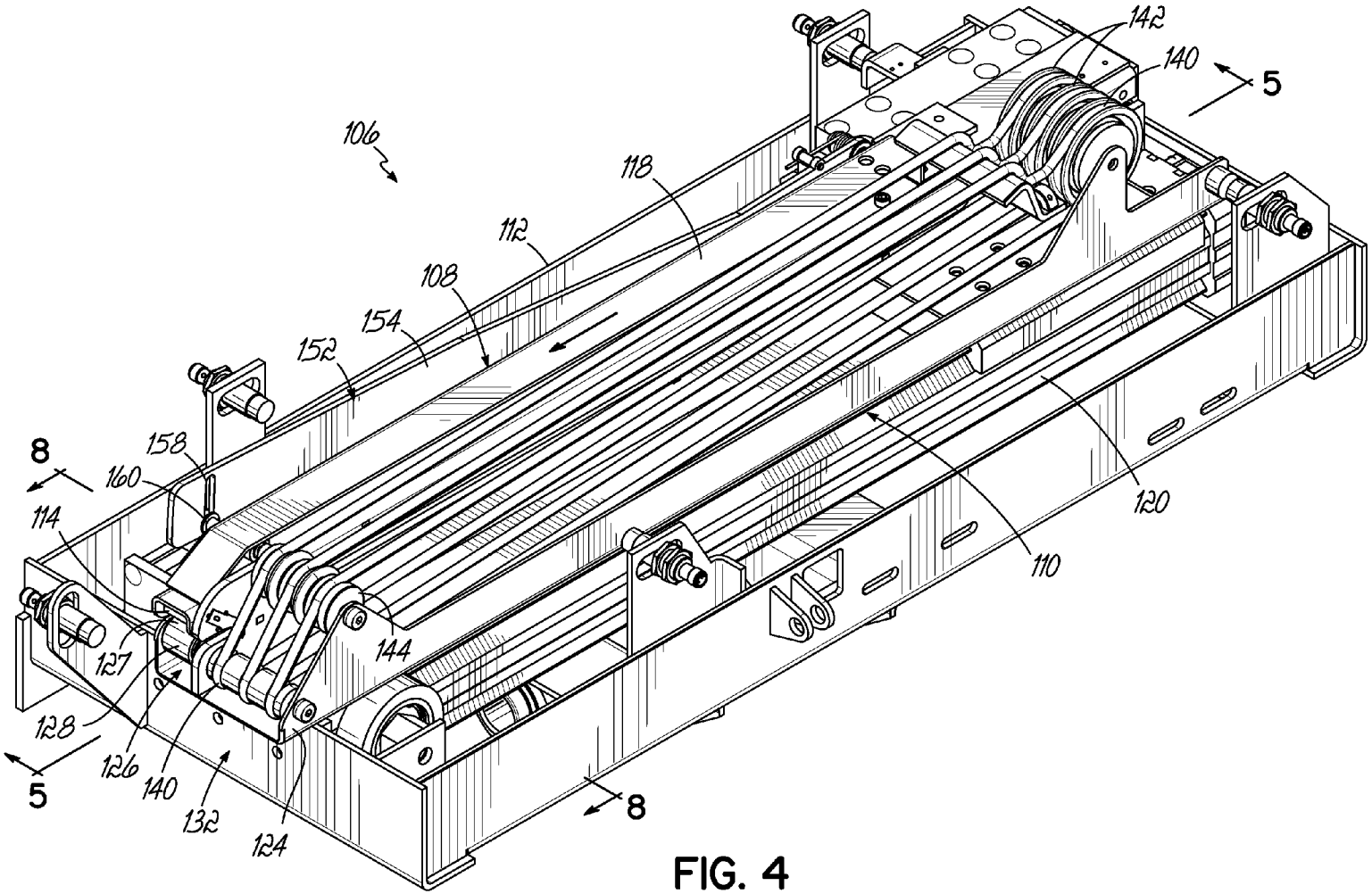
FIG. 4 is a perspective view of the clamp assembly of FIG. 1, according to an aspect of the present disclosure.
Figure 5:
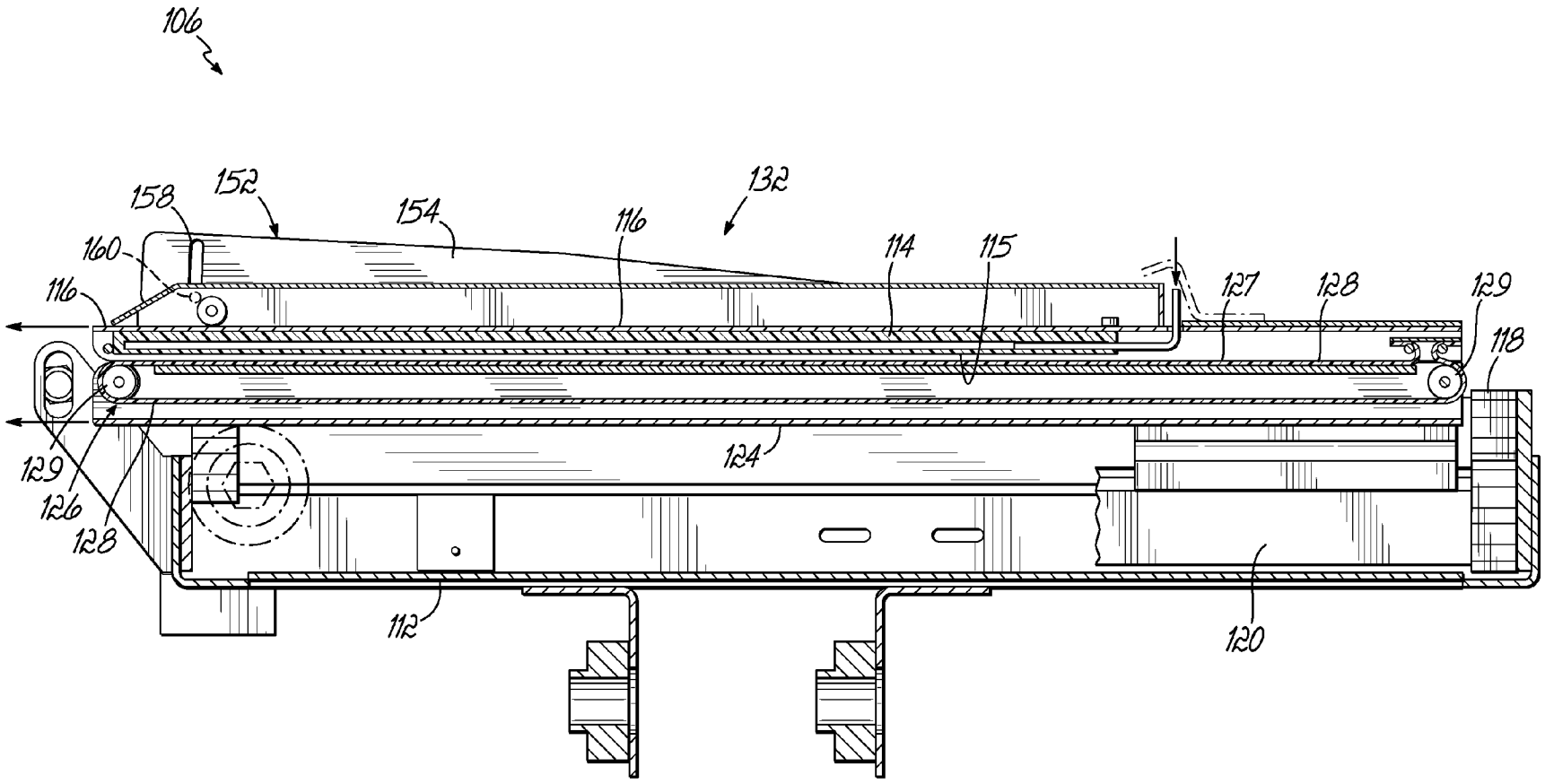
FIG. 5 is a cross-sectional view of the exemplary clamp assembly of FIG. 4, taken along line 5-5.

FIG. 1 depicts a stretch wrapping apparatus 100 for wrapping a load 102 with packaging material 104 as depicted in FIGS. 10A-10D. The apparatus 100 may include an exemplary clamp assembly 106 having opposed first and second jaw members 108 and 110, each of which is movably mounted on a housing 112. The first and second jaw members 108 and 110 may lie substantially parallel with one another, and may be spaced from one another so as to receive the packaging material 104 therebetween. A length of each of the first and second jaw members 108 and 110 may be greater than an effective height (H) of the packaging material 104, the effective height (H) of the packaging material 104 corresponding to a distance between top and bottom edges of the packaging material 104 during wrapping of the load 102 as depicted in FIG. 6C.

The first jaw member 108 and/or the second jaw member 110 may include low friction outer surfaces. The low friction outer surfaces may be made from a nonstick material, such as Teflon™, or smooth metal, to minimize any undesirable frictional engagement between the outer surfaces and the packaging material 104. Additionally or alternatively, the first jaw member 108 and/or the second jaw member 110 may include low-friction panels (not shown) attached to their outer surfaces to minimize frictional engagement between the first and second jaw members 108 and 110 and the packaging material 104. For example, the outer surfaces of the first jaw member 108 and/or the second jaw member 110 may be similar to the outer surfaces of jaw members described in U.S. Patent Application Publication No. 2009/0293435.

As shown in FIGS. 2-5, and 8, the first jaw member 108 may include a first inflatable bladder 114 defining a first material engaging surface 115. The first jaw member 108 may also include a first support 116, such as a formed channel or u-shaped bracket, having a cavity extending longitudinally along the first support 116 configured to receive at least a portion of the first inflatable bladder 114. Additionally or alternatively, the first support 116 may include any other suitable longitudinally extending recess, opening, or channel for receiving the first inflatable bladder 114. It is contemplated, for example, that the first inflatable bladder 114 may be secured on or in the first support 116 by a channel or cavity similar to that described in U.S. Patent Application Publication No. 2009/0293435. Alternatively, the first inflatable bladder 114 may be mounted on or attached to a surface of the first support 116 without being received in a recess, cavity, or channel. For example, the first inflatable bladder 114 may be attached to the first support 116 with adhesive, fasteners, and/or any other suitable attachment member.

The first inflatable bladder 114 may be made of an elastomeric material, such as, for example, rubber. The first inflatable bladder 114 material may be selected based on its ability to frictionally engage the packaging material 104, as well as its ability to expand when pressurized. When the first inflatable bladder 114 is depressurized, it may cease to exert a force on the packaging material 104. Additionally or alternatively, when depressurized, the first inflatable bladder 114 may be contained within the first support 116 (i.e., may not extend beyond first support 116), out of contact with the packaging material 104.

The first inflatable bladder 114 may extend longitudinally along the first jaw member 108 and may be sized to extend along the entire effective height (H) of the packaging material 104. The exact dimensions for the first inflatable bladder 114 may vary depending on a number of factors, such as, for example, the dimensions of the packaging material 104, the degree of clamping force desired, user preference, and/or other considerations.

The first inflatable bladder 114 may be inflated using any suitable device (not shown) for delivering pressurizing fluid into the first bladder 114. For example, the first inflatable bladder 114 may be pressurized via a reciprocating pump, a rotary pump, other suitable pressurizing devices known in the art, and any suitable combinations thereof. The pressurizing system may be positioned on any suitable supporting surface on the apparatus 100.

As shown in FIGS. 2-5, 6A, and 6C, the clamp assembly 106 may include a first actuation mechanism 118 configured to selectively actuate the first jaw member 108 such that the first jaw member 108 moves relative to the housing 112 between an extended position (FIG. 6A), wherein the first jaw member 108 extends out from the housing 112, and a retracted position (FIG. 4), wherein the first jaw member 108 is contained by the housing 112. The first actuation mechanism 118 may include, for example, a rodless cylinder, piston cylinder arrangement, pulley system, other motive systems known in the art, or any suitable combination thereof, and may be mounted on the housing 112.

The clamp assembly 106 may also include a second actuation mechanism 120 configured to selectively actuate the second jaw member 110 such that the second jaw member 110 moves relative to the housing 112 between an extended position (FIG. 7A), where the second jaw member 110 extends out from the housing 112, and a retracted position (FIG. 4), where the second jaw member 110 is contained by the housing 112. It should be understood that when the first and second jaw members 108 and 110 are both retracted, the first jaw member 108 is positioned adjacent the second jaw member 110 in the housing 112. The second actuation mechanism 120 may be similar to the first actuation mechanism 118, and may be mounted on the housing 112. It is contemplated that the first and second jaw members 108 and 110 may be independently extendable and retractable relative to each other, and/or extendable and retractable as a unit. Actuation of the first and second actuation mechanisms 118 and 120 may be triggered by a controller 122, as described in more detail below.

As shown in FIGS. 2-5 and 8, the second jaw member 110 may include a second support 124 including, for example, a formed channel or C-shaped bracket. The second support 124 supports a belt assembly 126. The belt assembly 126 includes a fixed length belt 128 defining a second material engaging surface 127 of the second jaw member 110. Belt 128 is supported on the second support 124 and routed around one or more bearings or pulleys 129. While the belt assembly 126 shown and described herein includes a fixed length belt 128, it will be appreciated that belt assembly 126 may alternatively include a looped or endless belt rotatably mounted on the second support 124. The arrangement of the belt 128 and the bearings or pulleys 129 may be similar to the arrangement described in U.S. Pat. No. 4,761,934. It is contemplated that the belt 128 may be at least partially received in a longitudinally extending recess, opening, or channel in the second support 124. It is also contemplated that at least a portion of the belt 128 faces the first inflatable bladder 114.

The belt 128 may be movable relative to the second support 124, and may operate in a manner similar to the belt described in U.S. Pat. No. 4,761,934 when clamping the packaging material 104. For example, when the first jaw member 108 is in its extended position and the second jaw member 110 is in its retracted position, at least a portion of the packaging material 104 may be wrapped over the side of the first jaw member 108 on which the first inflatable bladder 114 is positioned. When the second jaw member 110 is moved to its extended position to clamp the packaging material 104 in conjunction with the first jaw member 108, the belt 128 of the second jaw member 110 may move with respect to the second support 124 by rotating around one or more of the bearings or pulleys 129 such that every portion of the belt 128 coming into contact with the packaging material 104 does not translate relative to the packaging material 104 after making contact with the packaging material 104. That is, the surface of the belt 128 opposing first bladder 114 may engage with packaging material 104, such that belt 128 "walks down" the clamped section of packaging material 104. This allows the packaging material 104 to be held between the first jaw member 108 and the second jaw member 110 when the jaw members 108 and 110 are moved to their extended positions, with substantially no reduction to the effective height of the packaging material 104 clamped between the first and second jaw members 108 and 110.

Pressurizing the first inflatable bladder 114 may assist with clamping of the packaging material 104 between the first and second jaw members 108 and 110. For example, as pressure increases in the first inflatable bladder 114, the first inflatable bladder 114 may expand toward the second jaw member 110. Thus, a surface of the first inflatable bladder 114 may exert a clamping force on the packaging material 104 positioned between the surface of the inflatable bladder and the belt 128. Use of a bladder 114 overcomes a number of the prior art disadvantages. For example, using a bladder 114 eliminates the need for extremely tight tolerances in the space between the first and second jaw members 108 and 110 since the bladder 114 can dynamically account for space between first and second jaw members 108 and 110. Additionally, use of the bladder 114 improves distribution of the clamping force along the entire length of the first bladder 114. As such, the packaging material 104 may be evenly clamped between first and second jaw members 108 and 110.

The packaging material 104 clamped between the first and second jaw members 108 and 110 may include an entirely flat portion of the packaging material 104, or alternatively, a portion of the packaging material 104 that is partially flat and partially roped or rolled into a cable. For example, the portion of the packaging material 104 that is clamped may be similar to packaging material having a roped or rolled edge as described in U.S. Pat. Nos. 7,779,607 B2, 7,568,327, and/or U.S. Patent Application Publication No. 2007/0209324. It is contemplated that in one embodiment, the roped or rolled portion of the packaging material 104 may include between approximately 3 to 5 inches of packaging material 104. However, it is possible for any amount of packaging material to be held within the clamp assembly 106 as long as the clamp assembly 106 is capable of holding the packaging material 104 during start-up of a wrapping cycle, and preventing premature withdrawal of the packaging material 104 from the clamp assembly 106 under forces exerted on the packaging material 104 during the wrapping process. Nevertheless, for efficiency it is desirable to maintain as much of the effective height of the packaging material 104 as possible when clamping.

Figures 6A, 6B:
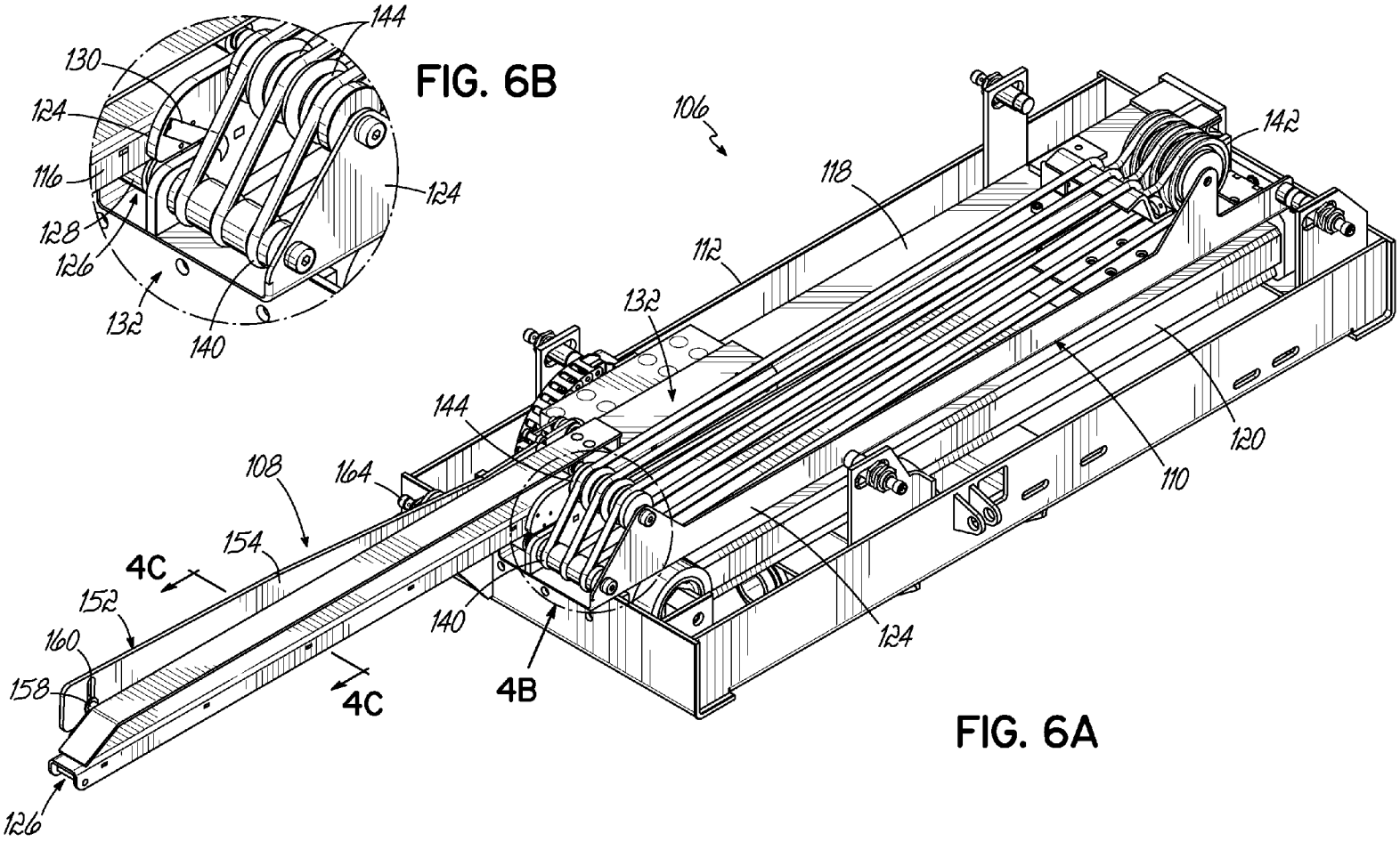
FIG. 6A is a perspective view of the clamp assembly of FIG. 4, with a first jaw in an extended position.
FIG. 6B is an enlarged view of the encircled portion of FIG. 6A.
Figure 6C:
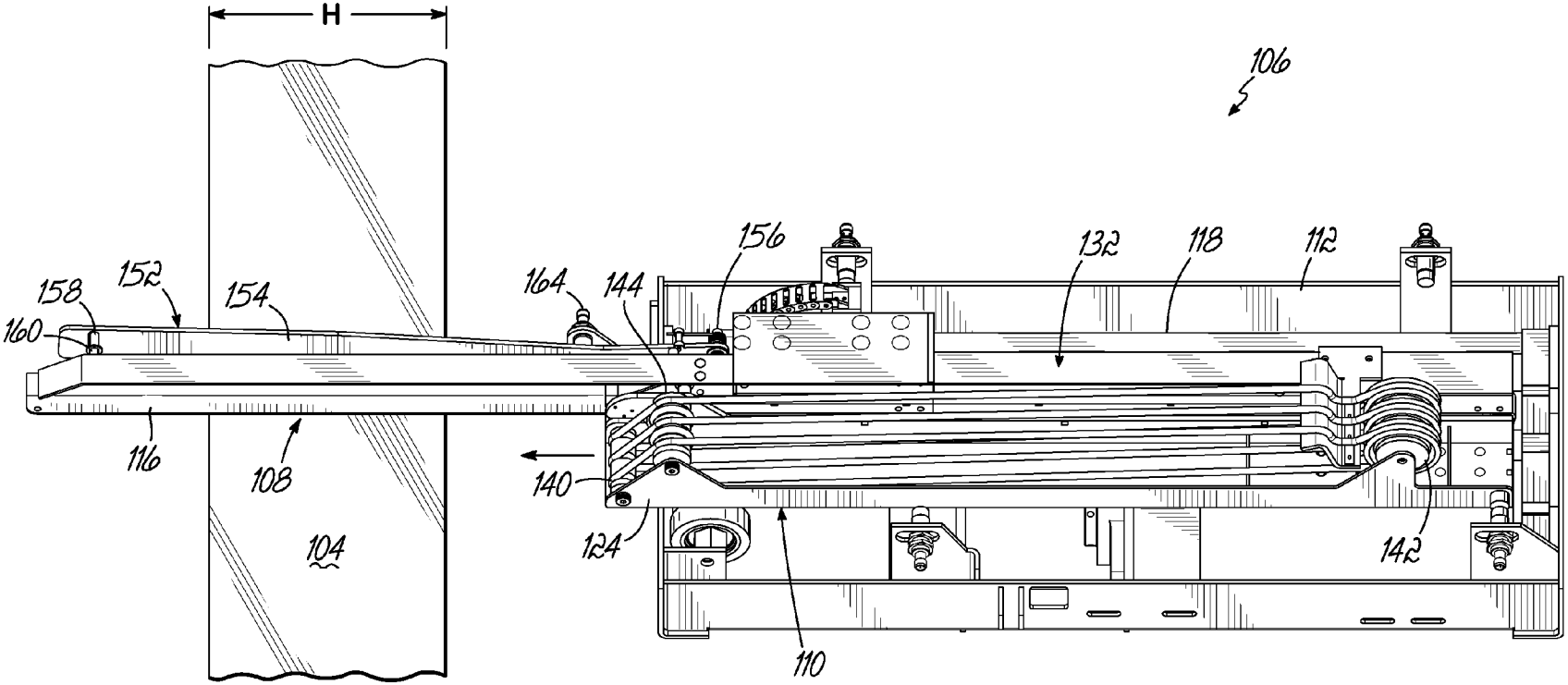
FIG. 6C is a perspective view, similar to FIG. 6A, illustrating engagement of the first jaw with packaging material.
Figures 7A, 7B:
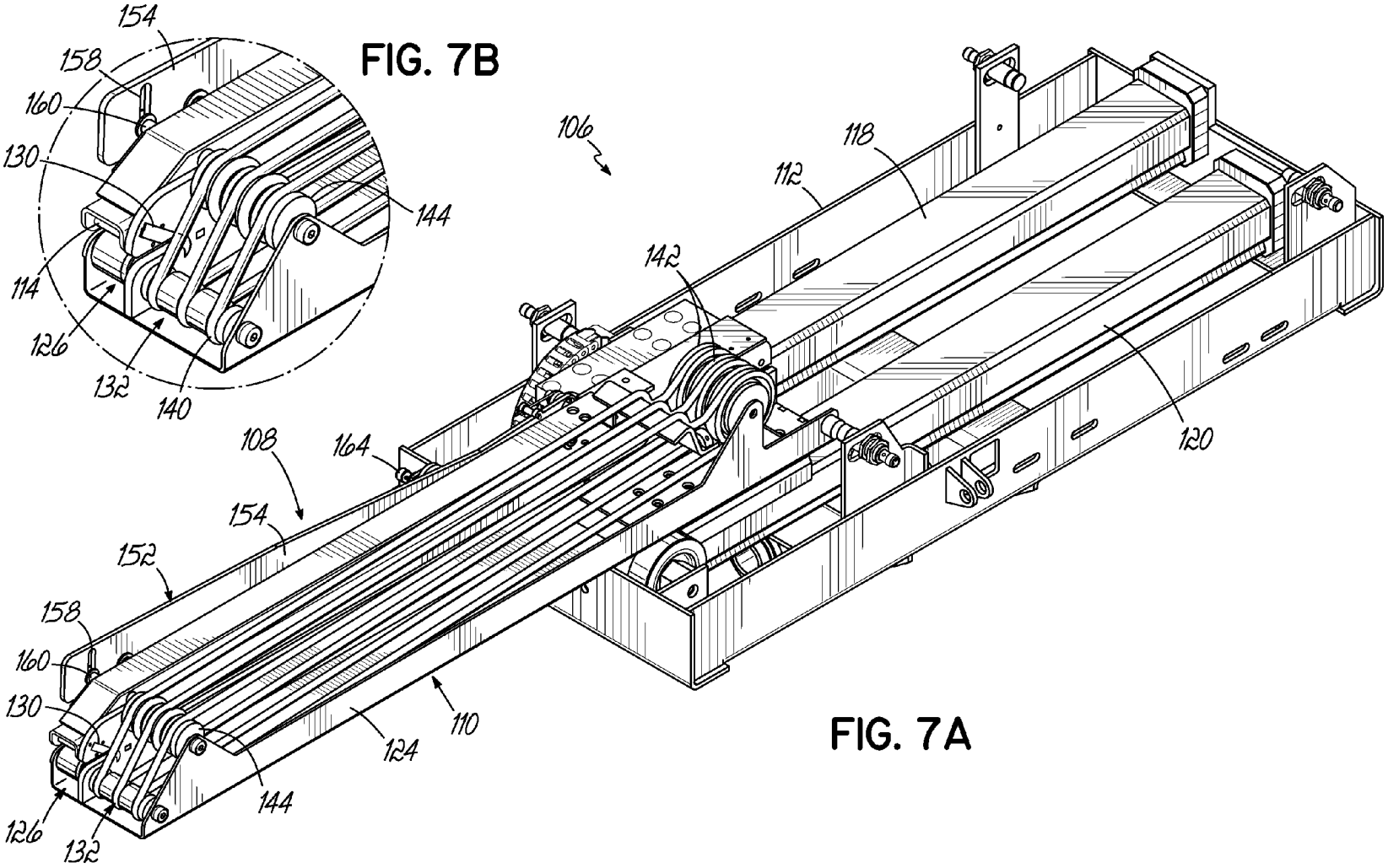
FIG. 7A is a perspective view of the clamp assembly of FIG. 4, similar to FIG. 6A, with first and second jaws in extended positions.
FIG. 7B is an enlarged view of the encircled portion of FIG. 7A.

As shown in FIGS. 6B and 7B, the second jaw member 110 may also include a cutting device 130 and a sealing assembly 132. The cutting device 130 may be mounted proximate a cantilevered end of the second jaw member 110. The cutting device 130 may include, for example, a razor blade mounted on the second support 124 such that the razor blade travels alongside an edge of the first jaw member 108 when the first jaw member 108 is in its extended position and the second jaw member 110 is being moved to its extended position. The razor blade may have a sharp edge for cutting the packaging material 104 as the second jaw member 110 is extended. The cut may be made in the packaging material 104 along a portion of the packaging material 104 adjacent the portion held between the first inflatable bladder 114 of the first jaw member 108 and the belt 128 of the second jaw member 110. For example, the cutting device 130 may be similar to the blade described in U.S. Pat. No. 4,761,934.

Additionally or alternatively, it is contemplated that the cutting device 130 may include a hot wire (not shown) extending along the height of at least one of the first and second jaw members 108 and 110. In such an embodiment, the hot wire may be heated for cutting the packaging material 104.

Figure 10A:
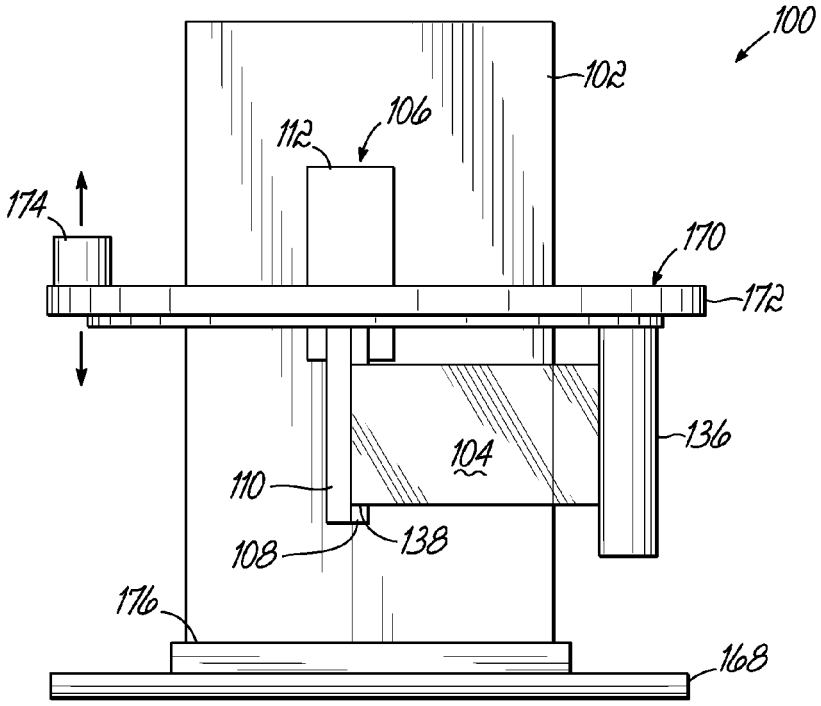
FIGS. 10A-10D are schematic drawings illustrating stages of a wrapping cycle, in accordance with an aspect of the present disclosure.
Figure 10B:
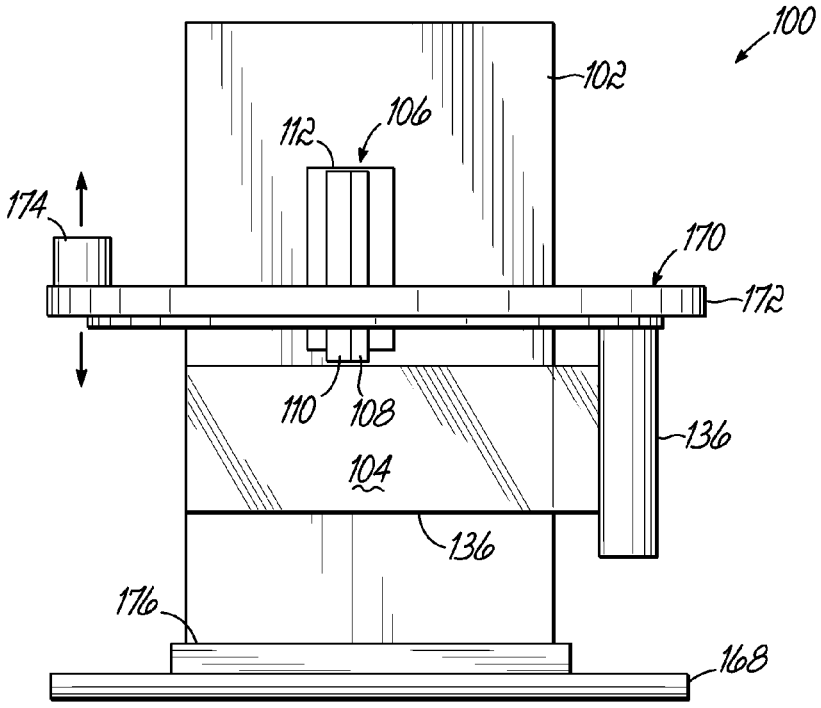
Figure 10C:
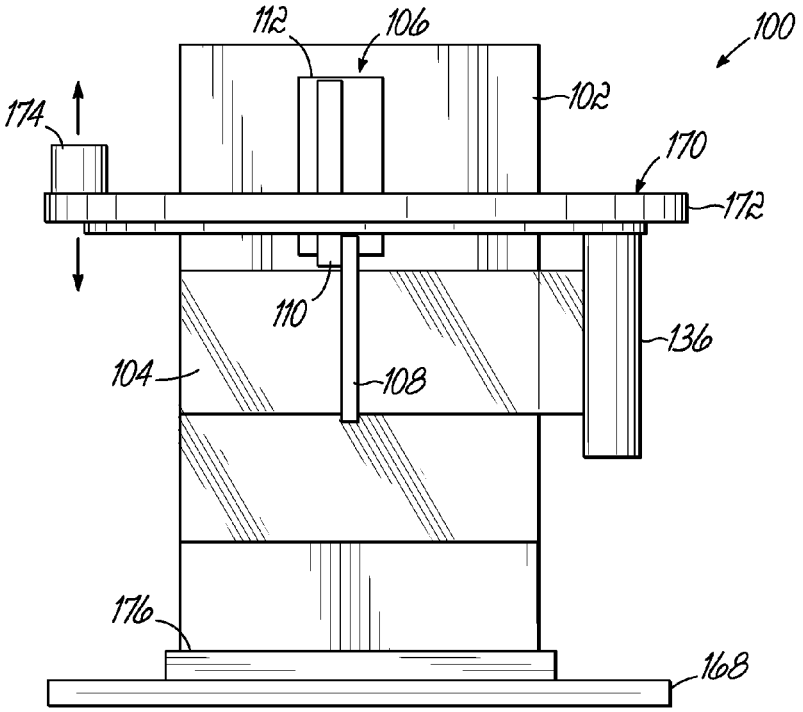
Figure 10D:
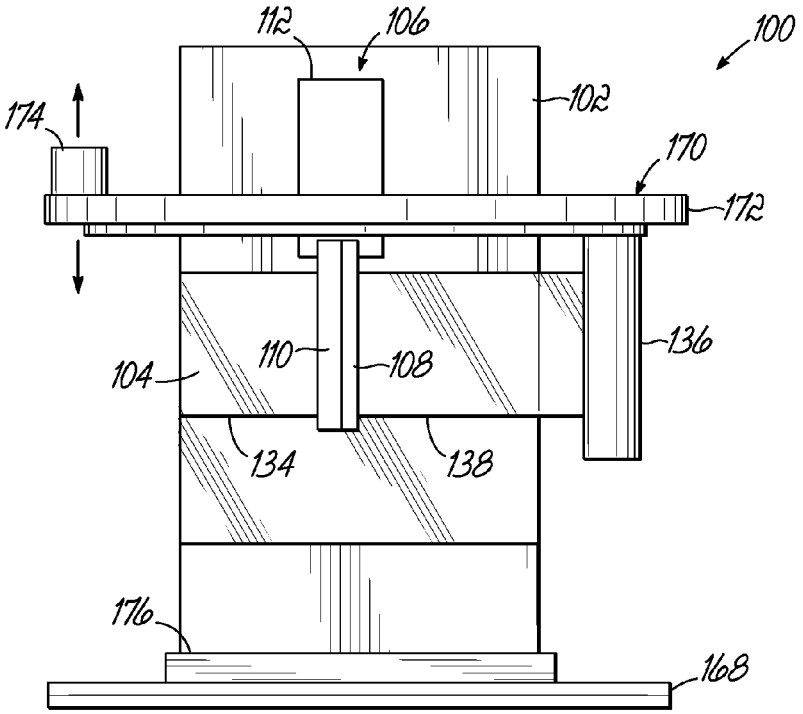

When the cutting device 130 cuts the packaging material 104, one side of the packaging material 104, the side that extends to the load 102, may become a trailing end 134, while the other side of the packaging material 104, the side that extends to a packaging material dispenser 136, may become a new leading end 138. As shown in FIG. 10D, after the cutting step, the new leading end 138 of packaging material 104 remains clamped between the first and second jaw members 108 and 110, in preparation for wrapping a subsequent load.

The sealing assembly 132 may also be coupled to the second jaw member 110, and may be configured to press or seal the trailing end 134 against a wrapped load surface subsequent to cutting of the packaging material 104. As shown and embodied in FIGS. 2-4, 6A-6C, 7A-7B, and 8, the sealing assembly 132 may include one or more pressing belts 140. For example, the sealing assembly 132 may include three pressing belts 140, It is to be understood that any number of pressing belts 140 sufficient to seal down packaging material 104 may be used. The pressing belts 140 may be made of a flexible plastic, such as, for example, polyethylene. Alternatively, any suitable flexible material may be used.

At least a portion of the pressing belts 140 may be mounted in a recess, opening, or channel, such as the one shown in the second support 124. The pressing belts 140 may be rotatably mounted on the second jaw member 110 by one or more bearings or pulleys, such as, for example, pulleys 142 and 144. The pressing belts 140 may be movable relative to the second support 124, and may operate in a manner similar to the belt 128 and the belt described in U.S. Pat. No. 4,761,934. For example, when the first jaw member 108 is in its extended position and the second jaw member 110 is in its retracted position, at least a portion of the packaging material 104 may be wrapped over the side of the first jaw member 108 on which the first inflatable bladder 114 is positioned. When the second jaw member 110 is moved to its extended position the cutting device 130 cuts the packaging material 104 to form the leading end 138 and the trailing end 134, and the pressing belts 140 may press the trailing end 134 against the wrapped load surface. As the pressing belts 140 engage the trailing end 134, the pressing belts 140 may move with respect to the second support 124 by rotating around the pulleys 142 and 144 such that at least portions of the pressing belts 140 contacting the trailing end 134 do not translate relative to the trailing end 134 after making contact. Thus, the pressing belts 140 help maintain the trailing end 134 of the packaging material 104 in a substantially flat orientation, with little or no reduction in its effective height, while also pressing the trailing end 134 against the wrapped load 102 surface. Because the trailing end 134 undergoes substantially no reduction to its effective height, the trailing end 134 adheres easily to the wrapped load 102 surface. It is contemplated that sealing of the trailing end 134 against the wrapped load surface, clamping, and cutting all occur in one smooth operation during extension of the second jaw member 110.

As shown in FIG. 1, the clamp assembly 106 may be coupled to a non-rotating frame 146 by a support assembly, such as swing-arm assembly 148, such that the clamp assembly 106 is cantilevered from the non-rotating frame 146 by the swing-arm assembly 148. The first and second jaw members 108 and 110, when extended, may be further cantilevered from the housing 112. The swing-arm assembly 148 may include one or more linkages 150 configured to move the clamp assembly 106 between a first radially outward position spaced apart from a surface of the load 102, and a second radially inward position contacting the surface of the load 102, as illustrated generally in FIG. 9.

Figure 9:
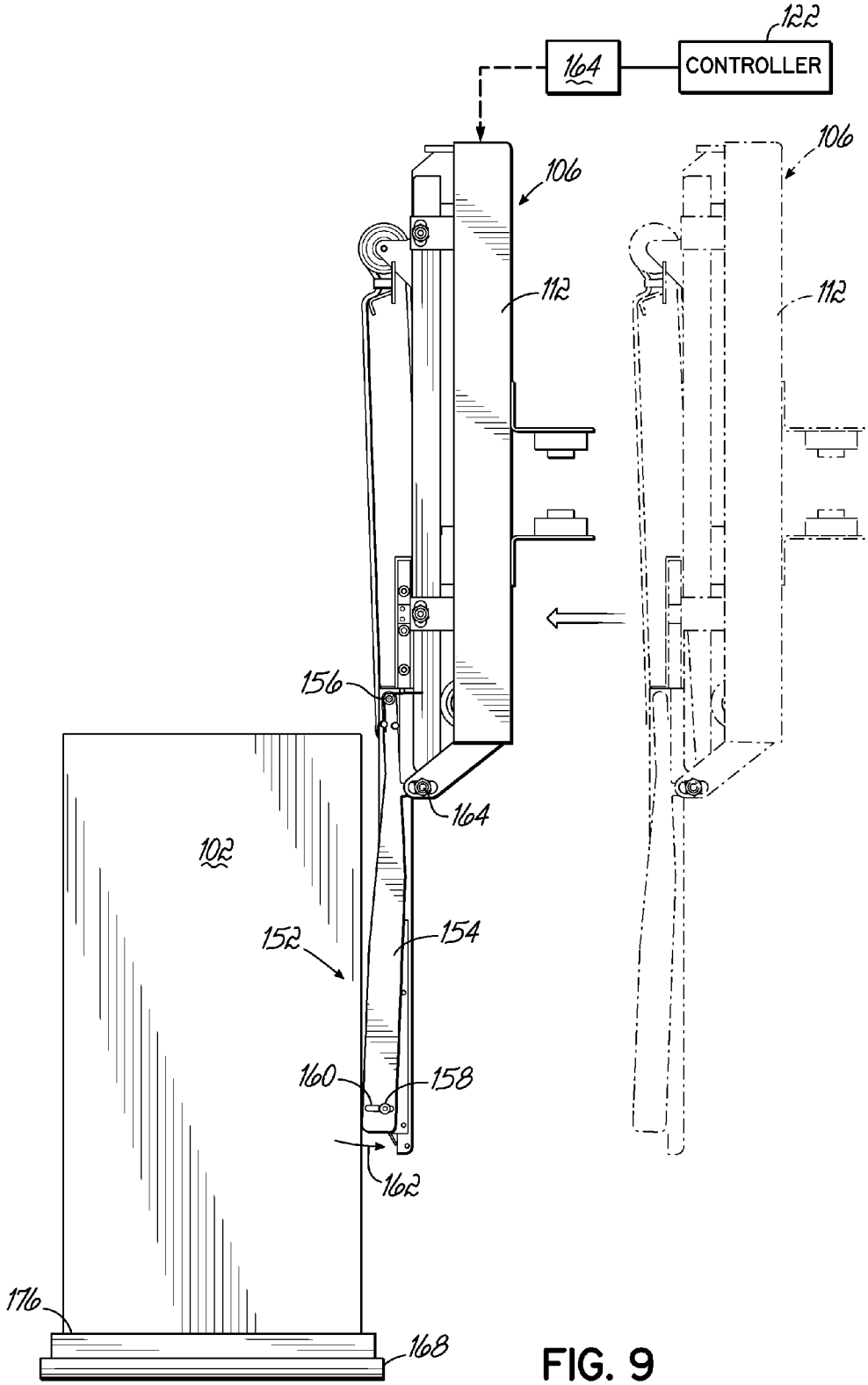
FIG. 9 is a partial elevation view of the clamp assembly of FIG. 1, illustrating a sensing assembly in accordance with an aspect of the present disclosure.

The linkages 150 may be arranged in a parallelogram form, with the different linkages rotatably coupled at their ends by pivot points. The pivot points allow the parallelogram formed by the linkages 150 to contract and expand when moving the clamp assembly 106 between the first and second positions. The contraction and expansion of the parallelogram creates a path of movement for the clamp assembly 106 that is substantially linear as the clamp assembly 106 moves toward and away from a surface of the load 102. Alternatively, the swing-arm assembly 148 may include any other structure suitable for supporting and moving the clamp assembly 106, such as a bar, a frame, a wire structure, a telescoping element, or a truss. The swing-arm assembly 148 may include any appropriate deployment mechanism (not shown), such as, for example, a hydraulic pressure cylinder, a pneumatic pressure cylinder, and/or solenoid actuator, configured to move the swing arm assembly 148, and in turn, move the clamp assembly 106 between its first and second positions. The deployment mechanism may be controlled by the controller 122 (FIG. 9). The controller 122 may actuate the deployment mechanism at a desired time during the wrap cycle to move the clamp assembly 106 toward the load 102 or away from the load 102.

As shown in FIGS. 4, 5, 6A, and 6C, a sensing assembly 152 may be provided on the first jaw member 108. The sensing assembly 152 may be configured to sense a position of the clamp assembly 106 relative to the load 102. The sensing assembly 152 may include an elongated bar or plate 154 whose top end is attached to a top end of the first jaw member 108 by a pivot or bearing 156 proximate the top end of the first jaw member 108. The elongated bar 154 may include a slot 158 near its bottom end configured to receive a post 160 on the first jaw member 108. The post 160 may extend from the first support 116 of the first jaw member 108. The elongated bar 154 may be spring-biased such that a lower portion of the elongated bar 154 extends away from the first jaw member 108 and toward the load 102 in the absence of a counteracting force.

As the swing-arm assembly 148 moves the clamp assembly 106 toward its second position, the lower portion of the elongated bar 154 contacts a surface of the load 102, or if the load 102 has been wrapped, a surface of the packaging material 104 on the load 102. Further movement of clamp assembly 106 towards its second position may cause the elongated bar 154 to pivot relative to the first jaw member 108 in a direction indicated by an arrow 162 (see FIG. 9) as post 160 moves within slot 158. A sensor 164, such as a position sensor, laser sensor, photodetector, or any other suitable sensor device, may monitor the position of a portion of the elongated bar 154.

With continued reference to FIG. 9, sensor 164 may send a position signal to a controller 122 that controls actuation of the deployment mechanism that moves the swing-arm assembly 148 and the clamp assembly 106. The controller 122 may output a stop command to the deployment mechanism when the position signal indicates that the clamp assembly 106 has reached a desired position relative to the surface of the load 102. In this manner, the sensing assembly 152 prevents the clamp assembly 106 from being damaged by being pressed against the load 102 with excessive force, and also prevents the clamp assembly 106 from causing an undesired shifting of the load 102, or from damaging the load 102 or layers of packaging material 104 wrapped thereon.

Figure 8:
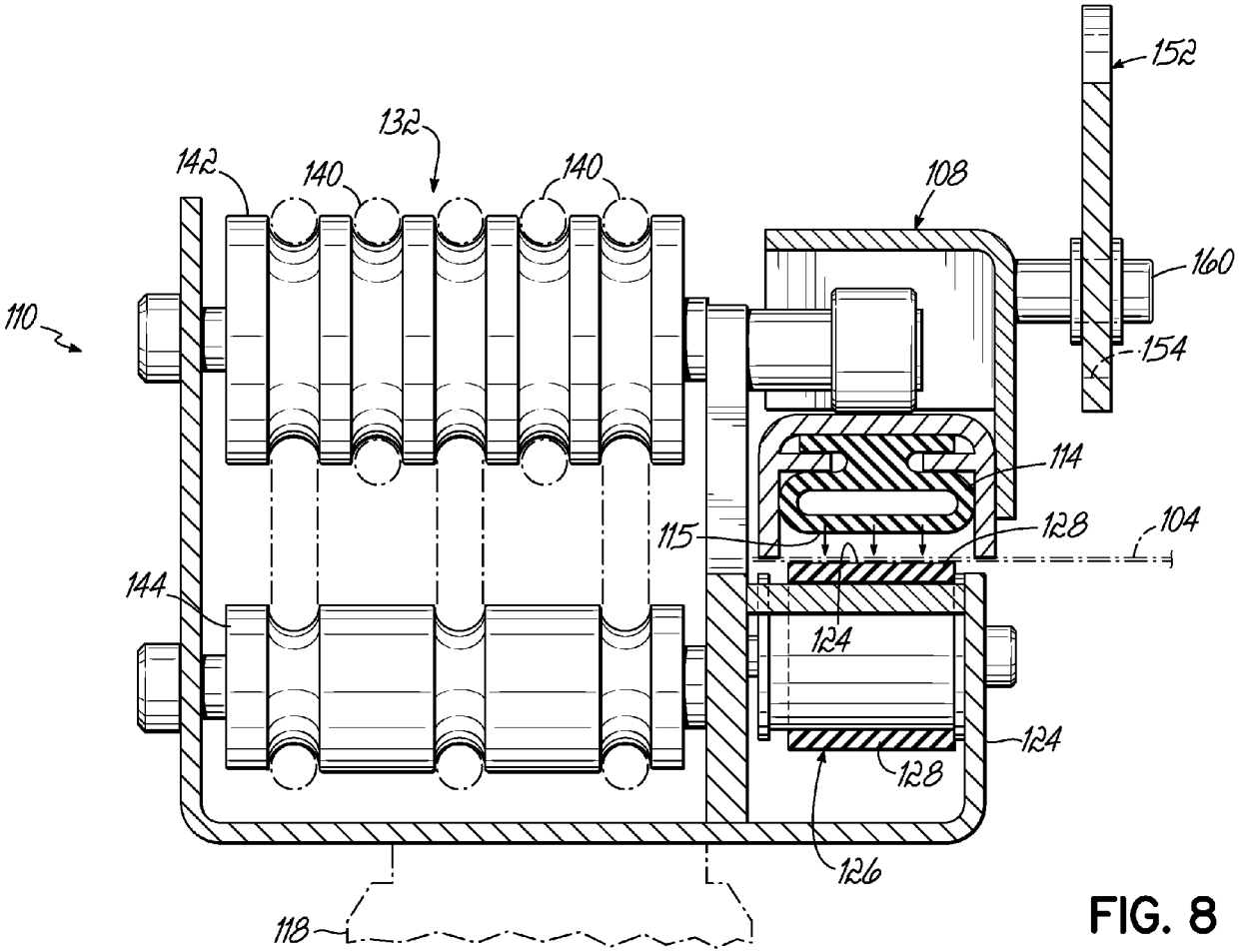
FIG. 8 is a cross-sectional view of the clamp assembly of FIG. 4, taken along line 8-8.
Figure 8A:
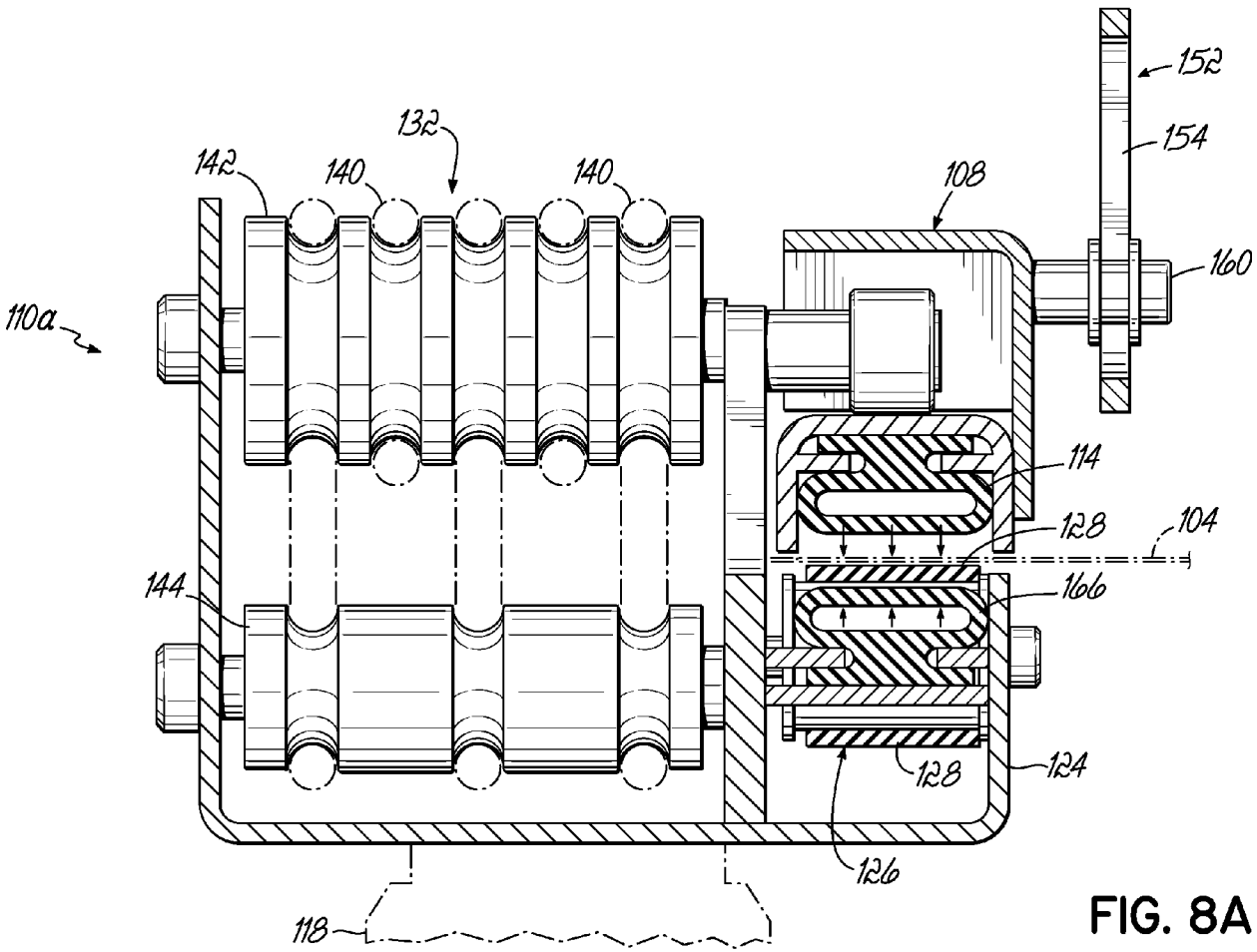
FIG. 8A is a cross-sectional view, similar to FIG. 8, of another exemplary clamp assembly in accordance with an aspect of the present disclosure.

FIG. 8A depicts another exemplary clamp assembly 106*a* having a second jaw member 110*a*, similar to the second jaw member 110 shown and described above with respect to FIGS. 2-5 and 6A-6C. In this exemplary embodiment, the second jaw member 110*a* includes a second inflatable bladder 166. The second inflatable bladder 166 may be similar to the first inflatable bladder 114 on the first jaw member 108 in form and operation, and also similar to the bladder in U.S. Patent Application Publication No. 2009/0293435. Any appropriate device for pressurizing the second inflatable bladder 166 may be employed, including, for example, a reciprocating pump, a rotary pump, other pressurizing systems known in the art, and any suitable combinations thereof. The pressurizing system may be positioned on the second jaw member 110*a*, the housing 112, the clamp swing-arm assembly 148, or any other appropriate location on apparatus 100.

The second inflatable bladder 166 may be mounted in a recess, opening, or channel, such as the cavity shown in second support 124 of the second jaw member 110*a*. Alternatively, the second inflatable bladder 166 may be mounted on or attached to a surface of the second jaw member 110*a* without being received in a cavity. For example, the second inflatable bladder 166 may be attached to the second jaw member 110*a* with adhesive, brackets, fasteners, and/or any other suitable attachment member.

The second inflatable bladder 166 may be positioned under the belt 128. That is, the second inflatable bladder 166 may be disposed between a surface of the second support 124 and the belt 128. In other words, the second inflatable bladder 166 may be disposed in contact with a surface of the belt 128 that does not contact the packaging material 104. Accordingly, when the second inflatable bladder 166 is pressurized, the belt 128 may be urged toward the first inflatable bladder 144, thus enhancing the clamping force exerted on the packaging material 104 by the belt 128 and the first inflatable bladder 114.

When the second inflatable bladder 166 is depressurized, it may cease to urge the belt 128 against the packaging material 104. Additionally or alternatively, when the second inflatable bladder 166 is depressurized, the second inflatable bladder 166 may be contained within the second support 124 (i.e., may not extend beyond the second support 124).

It is also contemplated that a second jaw member (not shown) may be provided that does not include a belt. Such a second jaw member may include, for example, a Teflon-coated bar, or rod, configured to extend to a position near the first jaw member 108, with inflation of the first inflatable bladder 114 allowing the inflatable bladder 114 to extend across a gap to the second jaw member to clamp the packaging material 104 between the second jaw member and the first jaw member 108. This embodiment of the second jaw member may also include an inflatable bladder that may be inflated to assist with clamping.

With continued reference to FIG. 1, and referring further to FIGS. 10A-10D, apparatus 100 is configured to wrap the packaging material 104 around the load 102. The apparatus 100 includes the nonrotating frame 146 (FIG. 1) defining a wrapping space. The load 102 may be conveyed by a conveyor 168 into the wrapping space prior to wrapping, and out of the wrapping space subsequent to wrapping. The conveyor 168 may include a conveyor belt having either powered or unpowered rollers, or a drag-chain conveyor.

The packaging material dispenser 136 is provided such that it dispenses the packaging material 104. The packaging material dispenser 136 may include a prestretch assembly for pre-stretching the packaging material 104 before it is applied on the load 102. The apparatus 100 may also include a relative rotation assembly 170 for providing relative rotation between the packaging material dispenser 136 and the load 102. The relative rotation assembly 170 may include, for example, a rotating arm, a rotatable turntable, or a rotating ring 172 shown in FIG. 1.

In the embodiment shown, the apparatus 100 also includes a vertical drive assembly 174 for providing relative movement between the packaging material dispenser 136 and the load 102 in a vertical direction, along the axis of rotation of the packaging material dispenser 136 relative to the load 102. The relative rotation between the packaging material dispenser 136 and the load 102, in combination with the relative vertical movement of the packaging material dispenser 136 relative to the load 102, may serve to wrap the packaging material 104 spirally around the load 102 and a pallet 176 supporting the load 102. The packaging material dispenser 136, relative rotation assembly 170, and vertical drive assembly 174 may be similar to those described in U.S. Pat. Nos. 7,779,607 B2, 7,707,801, and/or U.S. Patent Application Publication No. 2009/0178374.

With continued reference to the figures, and according to another aspect of this disclosure, there is provided a method of wrapping the load 102 with the packaging material 104 using the apparatus 100. The method may include positioning the load 102 to be wrapped in the wrapping space of the apparatus 100 using, for example, the conveyor 168. During positioning of the load 102 for wrapping, the swing-arm assembly 148 may hold the clamp assembly 106 in the radially outward position to prevent interference between the load 102 and the clamp assembly 106. As shown in FIG. 10A, the first and second jaw members 108 and 110 may be in their extended positions, and may hold a leading end 138 of the packaging material 104 therebetween. The first inflatable bladder 114 may be pressurized, and may exert a clamping force on the leading end 138 of the packaging material 104 by urging it against the belt 128. If the second jaw 110*a* is being used, the second inflatable bladder 166 may also be pressurized to urge the belt 128 toward the first inflatable bladder 114, thus further enhancing the clamping force on the leading end 138.

Once the load 102 to be wrapped is in position, the clamp assembly 106 is moved toward a surface of the load 102 (i.e., towards the second radially inward position of the clamp assembly 106) by movement of the swing-arm assembly 148. This movement may bring the first and second jaw members 108 and 110, as well as the leading end 138 clamped therebetween, proximate the load 102. At some point, the elongated bar 154 may be brought into contact with the surface of the load 102 and may begin to move. When the sensor 164 senses that movement of the elongated bar 154 has reached a threshold indicative of the clamp assembly 106 having reached a desired position relative to the surface of the load 102, the controller 122 outputs a stop command to the deployment mechanism moving the swing-arm assembly 148.

Relative rotation may be provided between the load 102 and the packaging material dispenser 136 to wrap the packaging material 104 around the load 102. At the end of the first relative revolution between the packaging material dispenser 136 and the load 102, the packaging material 104 is wrapped over the first and second jaw members 108 and 110 that are positioned proximate the load 102. Once the first and second jaw members 108 and 110 have been overwrapped one or more times, the first inflatable bladder 114 and/or the second inflatable bladder 166 may be depressurized to cease clamping of the leading end 138 of the packaging material 104. Then, as shown in FIG. 10B, the first and second jaw members 108 and 110 may be retracted and raised out of the packaging material dispensing path. Alternatively, depressurization of the first inflatable bladder 114 and/or the second inflatable bladder 166, and/or retraction of the first and second jaw members 108 and 110, may occur just prior to being overwrapped by the packaging material 104. The first and second jaw members 108 and 110 may be retracted substantially simultaneously or in any suitable order.

The first and second jaw members 108 and 110 may be raised through actuation of the first and second actuation mechanisms 118 and 120, which may be controlled by the controller 122. Once the first and second jaw members 108 and 110 have been raised, the leading end 138 may be held in place by the overwrapped layers of the packaging material 104. Moreover, elastic recovery in the overwrapped layers may cause the layers to snap back toward the load 102, thus securing the leading end 138. With the first and second jaw members 108 and 110 free of the packaging material 104, the controller 122 may actuate the swing-arm assembly 148 to move the clamp assembly 106 away from load 102 (i.e., towards its first radially outward position).

The packaging material dispenser 136 may continue to dispense packaging material 104 to load 102 in a spiral fashion, as described in U.S. Pat. No. 7,779,607. As the end of the wrap cycle approaches, and as shown in FIG. 10C, the first jaw member 108 may be extended and, along with the rest of the clamp assembly 106, may be moved toward the wrapped surface of the load 102 (i.e., toward its first radially inward position) by the swinging of the swing-arm assembly 148. The controller 122 stops moving the clamp assembly 106 toward the wrapped surface of the load 102 when the sensor 164 and the elongated bar 154 indicate that the desired position has been reached. At least one layer of the packaging material 104 may be wrapped over the first jaw member 108. The first inflatable bladder 114 may be pressurized at this time. Alternatively, the first inflatable bladder 114 may remain unpressurized.

As shown in FIG. 10D, the second jaw member 110 is actuated to move to its extended position substantially parallel to and adjacent the first jaw member 108. As the second jaw member 110 begins to move toward its extended position, the belt 128 may engage the packaging material 104, pressing the packaging material 104 against the first inflatable bladder 114. The cutting device 130 also begins cutting the packaging material 104 as the second jaw member 110 extends, creating a new leading end portion 138 on the side of the cut with the packaging material 104 that is held by the jaw members 108 and 110, and a new trailing end portion 134 on the side of the cut with the packaging material 104 that extends to the wrapped load 102. Additionally, the pressing belts 140 begin to engage the new trailing end portion 134 by pressing or sealing the new trailing end portion 134 against the wrapped load 102 surface. Continued extension of the second jaw member 110 brings continued clamping, cutting, and sealing. If the first inflatable bladder 114 has not been pressurized, it may be pressurized during extension of the second jaw member 110, or after extension, to assist with clamping.

Engagement of the belt 128 with the packaging material 104 helps to maintain the leading end 138 of the packaging material 104 in a relatively flat position as the second jaw member 110 is extended and the packaging material 104 is cut by the cutting device 130. Because the packaging material 104 is held relatively flat, its effective height is not reduced as would be the case if the packaging material 104 was collapsed into a rope or cable, thus providing for more efficient use of the packaging material 104. Engagement of the pressing belts 140 with the packaging material 104 helps to press or seal the trailing end 134 of the packaging material 104 against the wrapped load surface with little or no reduction in the effective height of the trailing end 134, thus providing for better adherence between the trailing end 140 and the layers of the packaging material 104 on the load 102.

After the second jaw 110 has been fully extended, and clamping, cutting, and sealing of the packaging material 104 has occurred, the controller 122 moves the swing-arm assembly 148 away from the wrapped load 102, bringing the extended first and second jaw members 108 and 110 away from the wrapped load 102. During travel away from the wrapped load 102, both the first and second jaw members 108 and 110 remain extended, and continue clamping the leading end 138, maintaining the leading end 138 in place. Moving the first and second jaw members 108 and 110 gets them out of the way of the wrapped load 102 as the wrapped load 102 is conveyed out of the wrapping area by the conveyor 168. A new unwrapped load 102 may then be conveyed into the wrapping area, and the method may repeat for another wrap cycle.

While the present invention has been illustrated by the description of one or more embodiments thereof, and while the embodiments have been described in considerable detail, they are not intended to restrict or in any way limit the scope of the appended claims to such detail. The various features shown and discussed herein may be used alone or in combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. An apparatus for wrapping a load with packaging material, comprising:

a packaging material dispenser configured to dispense packaging material to the load;

a clamp assembly for clamping the packaging material, comprising:

a first jaw member, a first inflatable bladder on the first jaw member, a second jaw member positioned adjacent and parallel to the first jaw member, and a movable belt on the second jaw member, the first and second jaw members defining a space for receiving the packaging material between the inflatable bladder and the belt;

a support assembly supporting the clamp assembly for movement between a first position spaced radially outwardly from the load, and a second position closer to the load; and a sensing assembly configured to sense a position of the clamp assembly relative to the load.

2. The apparatus of claim 1, wherein the clamp assembly further comprises a housing, and wherein first and second jaw members are selectively movable between retracted positions and extended positions relative to the housing.

3. The apparatus of claim 2, wherein the first and second jaw members are spaced from the packaging material in the respective retracted positions, and are positioned for engagement with the packaging material in the respective extended positions.

4. The apparatus of claim 2, wherein the first and second jaw members are cantilevered from the housing in the respective extended positions.

5. The apparatus of claim 2, wherein the belt is moved on the second jaw member as the second jaw member is moved toward the extended position to receive the packaging material between the first and second jaw members, such that every portion of the belt that comes into contact with the packaging material does not translate relative to the packaging material after making contact and the second jaw member walks down the clamped portion of the packaging material.

6. The apparatus of claim 1, wherein the inflatable bladder is selectively pressurized and de-pressurized to assist with clamping and unclamping of the packaging material between the first and second jaw members.

7. The apparatus of claim 1, further comprising:

a relative rotation assembly providing relative rotation between the packaging material dispenser and the load.

8. The apparatus of claim 7, wherein the relative rotation assembly comprises a rotating ring.

9. The apparatus of claim 7, further comprising:

a vertical drive assembly providing relative movement between the packaging material dispenser and the load along a direction substantially parallel to an axis of rotation of the relative rotation between the packaging material dispenser and the load.

10. The apparatus of claim 1, wherein the support assembly comprises a rotatable swing arm assembly.

11. The apparatus of claim 10, wherein the swing arm assembly comprises one or more linkages defining a parallelogram form movable between a contracted configuration and an expanded configuration such that when the parallelogram form moves to the contracted configuration the clamp assembly moves to the first position, and when the parallelogram form moves to the expanded configuration the clamp assembly moves to the second position.

12. The apparatus of claim 1, wherein the sensing assembly includes an elongated bar moveably coupled to the first jaw member.

13. The apparatus of claim 12, wherein the elongated bar pivots relative to the first jaw member upon contacting the load.

14. The apparatus of claim 12, wherein the sensing assembly further includes a position sensor that senses a position of the elongated bar and sends a position signal to a controller, the controller stopping further movement of the clamp assembly toward the load in response to the signal.

15. The apparatus of claim 1, further comprising: a second inflatable bladder on the second jaw member, with the belt disposed between the second inflatable bladder and the first inflatable bladder when the first and second jaw members are positioned adjacent one another.

16. The apparatus of claim 1, further comprising: a packaging material cutting device mounted on the second jaw member.

17. The apparatus of claim 16, wherein:

the clamp assembly further comprises a housing, and wherein first and second jaw members are selectively movable between retracted positions and extended positions relative to the housing; and the cutting device cuts packaging material received between the first and second jaw members as the second jaw member is moved to the extended position.

18. The apparatus of claim 1, wherein the second jaw member includes a bar or rod.

19. The apparatus of claim 18, wherein the bar or rod is at least partially coated in Teflon.

* * * * *